United States Patent [19]

Saha

[11] Patent Number: 4,855,206

[45] Date of Patent: Aug. 8, 1989

[54] RARE EARTH CONTAINING MAGNETIC CARRIER PARTICLES

[75] Inventor: Bijay S. Saha, Rochester, N.Y.

[73] Assignee: Eastman Kodak Company, Rochester, N.Y.

[21] Appl. No.: 229,382

[22] Filed: Aug. 5, 1988

[51] Int. Cl.[4] ..... G03G 9/14

[52] U.S. Cl. ..... 430/106.6; 430/108; 252/62.57

[58] Field of Search ..... 430/106.6, 108; 252/62.57

[56] References Cited

U.S. PATENT DOCUMENTS

| | | | |
|---|---|---|---|
| 3,193,502 | 7/1965 | Schieber . | |
| 4,172,722 | 10/1979 | Hirakura et al. | 423/594 |
| 4,540,645 | 9/1985 | Honda et al. | 430/122 |
| 4,546,060 | 10/1985 | Miskiwis et al. | 430/108 |
| 4,623,603 | 11/1986 | Iimura et al. | 430/108 |
| 4,636,433 | 1/1987 | Kubo et al. | 252/62.57 X |

FOREIGN PATENT DOCUMENTS

| | | | |
|---|---|---|---|
| 0109860 | 10/1987 | European Pat. Off. . | |
| 57-130403 | 8/1982 | Japan | 252/62.57 |
| 61-177469 | 8/1986 | Japan | 430/106.6 |
| 61-236560 | 10/1986 | Japan | 430/106.6 |

*Primary Examiner*—Roland E. Martin

*Attorney, Agent, or Firm*—Willard G. Montgomery

[57] ABSTRACT

Disclosed are carrier particles which comprise magnetically hard ferrite material having a single phase hexagonal crystal structure, and which contain neodymium, praseodymium, samarium, europium, or a mixture thereof, or a mixture of one or more of those elements with lanthanum. Also disclosed in an electrostatic two-component dry developer composition comprising charged toner particles mixed with oppositely charged carrier particles which comprise this hard ferrite material. A method for developing an electrostatic image by contacting the image with a two-component dry developer composition is also disclosed.

19 Claims, No Drawings

RARE EARTH CONTAINING MAGNETIC CARRIER PARTICLES

BACKGROUND OF THE INVENTION

This application is related to application Ser. No. 229,366, an improvement on the instant invention, filed of even date by B.S. Saha et al., titled "Interdispersed Two-Phase Composite."

This invention relates to electrostatography and more particularly it relates to rare earth containing magnetic carrier particles and developers for the dry development of electrostatic charge images.

In electrostatography, an electrostatic charge image is formed on a dielectric surface, typically the surface of the photoconductive recording element. Development of this image is commonly achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is known in the art to apply developer compositions of the above type to electrostatic images by means of a magnetic applicator which comprises a cylindrical sleeve of non-magnetic material having a magnetic core positioned within. The core usually comprises a plurality of parallel magnetic strips which are arranged around the core surface to present alternative north and south magnetic fields. These fields project radially, through the sleeve, and serve to attract the developer composition to the sleeve outer surface to form a brushed nap. Either or both the cylindrical sleeve and the magnetic core are rotated with respect to each other to cause the developer to advance from a supply sump to a position in which it contacts the electrostatic image to be developed. After development the toner depleted carrier particles are returned to the sump for toner replenishment.

As described in U.S. Patent Application Ser. No. 62,023, filed June 15, 1987 by B. S. Saha et al., titled "Electrographic Magnetic Carrier Particles," now U.S. Pat. No. 4,764,445, it was discovered that a hard magnetic ferrite material having a single phase hexagonal crystal structure could be formed which contained about 1 to about 5% by weight lanthanum. The lanthanum increased the conductivity of the material without adversely affecting its magnetic properties, resulting in superior magnetic carrier particles. The deleterious effect on magnetic properties was avoided only when a single phase crystal structure was formed, and magnetic properties were worsened when the lanthanum exceeded 5% and a single phase crystal structure was not formed. It is generally known that the conductivity of the carrier particles is directly proportional to the speed of development (the velocity of the photoconductive recording element over the magnetic brush) that can be employed, and a higher development speed means that more copies can be produced per unit time.

Attempts to form a single phase crystal structure using cerium (atomic number 57) instead of lanthanum (atomic number 56), did not result in a single phase crystal structure. Because cerium would not form a single phase crystal structure, other rare earths, farther from lanthanum in the Periodic Table, were also not expected to form single phase crystal structures.

SUMMARY OF THE INVENTION

Contrary to the expectations of those skilled in the art following the failure to make a cerium substituted ferrite, I have discovered that neodymium, praseodymium, samarium, and europium will in fact form a ferrite having a single phase hexagonal crystal structure. Like the lanthanum substituted ferrite, these ferrites exhibit increased conductivity without a loss in magnetic properties, and are very useful in making magnetic carrier particles and developers. It is surprising that these four elements form a single phase crystal structure in view of the inability of cerium to form such a structure.

I have also found that the oxides and carbonates of the four rare earth elements used in this invention, which are typically used in forming the ferrite, form a more homogenous dispersion than does lanthanum oxide or carbonate. The homogeneity of the dispersion of these compounds is not predictable, and the higher homogeneity of the oxides and carbonates of the four rare earth elements that are the subject of this invention is very important in the manufacture of large batches of the carriers, because higher homogeneity reduces settling of the rare earth compounds in the holding tanks during manufacture.

DETAILED DESCRIPTION OF THE INVENTION

The ferrite material used in this invention has a single phase hexagonal crystal structure and contains a rare earth element which can be either neodymium, praseodymium, samarium, europium, a mixture thereof, or a mixture of one or more of those elements with lanthanum. As a general rule, a single phase hexagonal crystal structure is obtained when the rare earth element in the ferrite is about 1 to about 5% by weight (based on ferrite weight). The ferrite material is magnetically "hard" as opposed to being magnetically "soft" where those terms have the generally accepted meaning as indicated on page 18, *Introduction to Magnetic Materials,* by B.D. Cullity, published by Addison-Wesley Publishing Company, 1972.

A general formula for the preferred ferrite material is $R_xM_{1-x}Fe_{12}O_{19}$ where R is the rare earth element, M is strontium, barium, calcium, lead, or a mixture thereof. Of these four elements, calcium is the least preferred and strontium is the most preferred because strontium is less toxic and more commercially accepted. In general, a single phase structure will be formed when "x" in the formula is about 0.1 to about 0.4 or, to put it another way, the rare earth element substitutes for about 1 to about 5% by weight of the ferrite, and preferably for about 2 to about 4.5% by weight.

The carriers of this invention can be prepared by conventional procedures that are well known in the art of making ferrites. Suitable procedures are described, for example, in U.S. Pats. Nos. 3,716,630, 4,623,603, and 4,042,518; European Patent Application No. 0 086 445; "Spray Drying" by K. Masters, published by Leonard Hill Books London, pages 502–509 and "Ferromagnetic Materials," Volume 3 edited E.P. Wohlfarth, and published by North Holland Publishing Company, Amsterdam, N.Y., page 315 et seq. Briefly, a typical preparation procedure might consist of mixing oxides or carbonates of the elements in the appropriate proportion with an organic binder and water and spray-drying the mixture to form a fine dry particulate. The particulate can then be fired, which produces the ferrite. The ferrite is magnetized and is typically coated with a polymer, as is well known in the art, to better enable the carrier particles to triboelectrically charge the toner particles. Since the presence of rare earth in the ferrite is intended to improve the conductivity of carrier particles, the layer of tribocharging resin on the carrier particles should be thin enough that the mass of particles remains conductive. Preferably the resin layer is discontinuous so that spots of bare ferrite on each particle provide conductive contact. The carrier particles can be passed through a sieve to obtain the desired range of sizes. A typical particle size, including the polymer coating, is about 5 to about 60 micrometers, but smaller sized carrier particles, about 5 to about 20 micrometers, are preferred as they produce a better quality image.

The ferrite carrier particles of this invention typically exhibit a coercivity of at least 300 Oersteds when magnetically saturated, and an induced magnetic moment of at least 15 EMU/gm of carrier in an applied field of 1000 Oersteds. The coercivity of a magnetic material refers to the minimum external magnetic force necessary to reduce the induced magnetic moment from the remanence value to zero while it is held stationary in the external field, and after the material has been magnetically saturated, i.e., the material has been permanently magnetized. A variety of apparatus and methods for the measurement of coercivity of the present carrier particles can be employed, such as a Princeton Applied Research Model 155 Vibrating Sample Magnetometer, available from Princeton Applied Research Co., Princeton, N.J. The powder is mixed with a nonmagnetic polymer powder (90% magnetic powder: 10% polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/gm) is plotted. During this measurement, the sample was exposed to an external field of 0 to 10,000 Oersteds.

The induced moment of composite carriers in a 1000 Oersteds applied field is dependent on the concentration of magnetic material in the particle. It will be appreciated, therefore, that the induced moment of the magnetic material should be sufficiently greater than 15 EMU/gm to compensate for the effect upon such induced moment from dilution of the magnetic material in the binder. For example, one might find that, for a concentration of 50 weight percent magnetic material in the composite particles, the 1000 Oersteds induced magnetic moment of the magnetic material should be at least 40 EMU/gm to achieve the minimum level of 15 EMU/gm for the composite particles.

The present invention comprises two types of carrier particles. The first of these carriers comprises a binder-free magnetic particulate material exhibiting the above-described coercivity and induced magnetic moment. This type is preferred.

The second is heterogeneous and comprises a composite of a binder and a magnetic material exhibiting the above-described coercivity and induced magnetic moment. The magnetic material is dispersed as discrete smaller particles throughout the binder; however, the resistivity of these binder type polymers should be comparable to the binderless carrier particles in order to fully obtain the advantages of this invention. It may therefore be desirable to add conductive carbon black to the binder to insure electrical contact between the ferrite particles.

A developer can be formed by mixing the carrier particles with toner particles in a suitable concentration. Within developers of the invention, high concentrations of toner can be employed. Accordingly, the present developer preferably contains from about 70 to 99 weight percent carrier and about 1 to 30 weight percent toner based on the total weight of the developer; most preferably, such concentration is from about 75 to 99 weight percent carrier and from about 1 to 25 weight percent toner.

The toner component of the invention can be a powdered resin which is optionally colored. It normally is prepared by compounding a resin with a colorant, i.e. a dye or pigment, and any other desired addenda. The amount of colorant can vary over a wide range, e.g., from 3 to 20 weight percent of the polymer. Combinations of colorants may be used. The toner can also contain minor components such as charge control agents and antiblocking agents.

The mixture is heated and milled to disperse the colorant and other addenda in the resin. The mass is cooled, crushed into lumps, and finely ground. The resulting toner particles range in diameter from 0.5 to 25 micrometers with an average size of 1 to 16 micrometers. Preferably, the average particle size ratio of carrier to toner lies within the range from about 15:1 to about 1:1. However, carrier-to-toner average particle size ratios of as high as 50:1 are also useful. Additional details describing the preparation and use of ferrite magnetic carrier particles and developers can be found in copending application Ser. No. 62,023, hereinbefore cited, and herein incorporated by reference.

The invention is further illustrated by the following examples.

EXAMPLES 1 TO 5

Powders of strontium carbonate or barium carbonate, iron oxide, and 25 atomic percent of a rare earth (based on the total atoms of rare earth plus strontium or barium), in the form of an oxide or carbonate, in the necessary proportions were weighed and mixed thoroughly. In a separate container, a stock solution was prepared by dissolving 4 weight percent (based on stock solution weight) of a binder resin and 0.4 weight percent ammonium polymethacrylate surfactant (sold by W. R. Grace and Co. as "Daxad-32") in distilled water. The powders were mixed with the stock solution in a 50:50 weight ratio, and the mixture was ball milled for about 24 hours then spray dried. The green bead particles thus formed were classified to obtain a suitable particle size distribution. The green bead was then fired at a temperature between 900° and 1250° C. for 10 to 15 hours. The following table gives the rare earth element used in the ferrite, the weight percent of the rare earth element in the ferrite (based on ferrite weight), the form of the rare earth in the starting composition, and whether the "M" element was strontium or barium.

| Example | Rare Earth | Wt % | Form | Sr or Ba |
|---|---|---|---|---|
| 1 | Pr | 3.28 | Carbonate | Sr |
| 2 | Pr | 3.17 | Carbonate | Ba |
| 3 | Nd | 3.35 | Oxide | Sr |
| 4 | Sm | 3.49 | Oxide | Sr |
| 5 | Eu | 3.52 | Oxide | Sr |

X-ray diffraction analysis showed that ferrites having a single phase hexagonal crystal structure were formed in each of the Examples 1 to 5. This procedure was repeated using cerium oxide as the rare earth compound, but a ferrite having a single phase crystal structure could not be formed.

EXAMPLE 6

This example compares the development charge of the ferrites prepared in Examples 1 to 3 with an identically prepared ferrite which did not contain any rare earth element. The development charge is the charge deposited on a photoconductive element by the developer during development. The higher is the development charge, the greater is the number of copies that can be made per unit time. The toner used was a standard black styrene butyl acrylate toner (Example 1 of U.S. Pat. No. 4,394,430) at a concentration of 10% by weight, based on total carrier plus toner weight. A linear xerographic device was used, and a D.C. bias was applied to the magnetic brush. During development, the charge on the photoconductive element was measured at different biases. The brush speed was 1000 rpm and the film speed was 25.4 centimeters per second.

| Magnetic Brush | Development Charge ($\times 10^{-7}$ $\mu$ coulomb) | | | |
|---|---|---|---|---|
| Bias (Volts) | Control | Example 1 | Example 2 | Example 3 |
| 0 | 0.649 | 0.669 | 0.722 | 0.672 |
| 25 | 0.911 | 1.66 | 1.48 | 1.56 |
| 50 | 1.69 | 3.12 | 3.21 | 3.29 |
| 75 | 2.53 | 4.71 | 4.57 | 5.15 |
| 100 | 3.59 | 6.71 | 6.75 | 6.85 |
| 125 | 4.62 | 8.59 | 7.71 | 8.32 |
| 150 | 5.39 | 9.42 | 9.79 | 9.89 |

The above table shows that the ferrite carriers containing neodymium or praseodymium had a development charge at a given bias of about twice the development charge for the control carrier at that bias, and therefore the carriers containing neodymium or praseodymium will be able to develop copies approximately twice as fast as the control carrier, which did not contain a rare earth element.

EXAMPLE 7

In this example the charge was measured on two toners, toner A, the styrene butyl acrylate toner used in Example 6, and Toner B, a black polyester toner, both at 10% by weight, based on total carrier plus toner weight. (The charge on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode the change in the electric charge is measured and is divided by the weight of toner that jumped.) The following table compares the charge on the toner 0.5 seconds and 30 seconds after initiation of the AC magnetic field, using the control carrier and three carriers from Examples 1, 2, and 3.

| | Toner A | | Toner B | |
|---|---|---|---|---|
| | Q/M 30 sec | Q/M 0.5 sec | Q/M 30 sec | Q/M 0.5 sec |
| Control | 37.3 | 18.3 | 29.4 | 17.4 |
| Ex. 1 | 28.1 | 14.8 | 26.8 | 15 |
| Ex. 2 | 26.7 | 14 | 26 | 15.2 |
| Ex. 3 | 25.7 | 14.3 | 25.1 | 15 |

The above table shows that the charging characteristics of the rare earth containing ferrites are comparable to those of the control.

EXAMPLE 8

In this example the throw off was measured using two toners, toner A, the styrene butyl acrylate toner used in Example 6, and Toner B, the black polyester toner used in Example 7, both at 10% by weight, based on total carrier plus toner weight. The throw off is a measurement of the strength of the electrostatic bond between the toner and the carrier. A magnetic brush loaded with toner is rotated and the amount of toner that is thrown off the carrier is measured. A device employing a developer station as described in U.S. Pat. No. 4,473,029 and a Buchner funnel disposed over the magnetic brush such that the filter paper is in the same relative position as the photoreceptor was used to determine throw-off of developer during rotation of the brush. The brush is rotated for each carrier for two minutes while vacuum is drawn and developer is collected on the filter paper. The following table compares the throw off of the toner when the control carrier was used and when the three carriers prepared in Examples 1, 2, and 3 were used.

| | Toner A | Toner B |
|---|---|---|
| | Throw Off (mg) | Throw Off (mg) |
| Control | 8.3 | 3.2 |
| Example 1 | 6.3 | 3.6 |
| Example 2 | 4.7 | 3.1 |
| Example 3 | 7.8 | 4.5 |

The above table shows that the throw off of the rare earth containing ferrites is within acceptable limits and is comparable to the throw off of the control. Examples 6 and 7 demonstrate that the rare earth containing ferrites will perform as well in an electrostatographic process as does the control. Ferrites containing samarium, europium, or mixtures of neodymium, praseodymium, samarium, europium, and lanthanum will perform about as well as the ferrites illustrated.

The invention has been described in detail with particular reference to preferred embodiments thereof, but it will be understood that variations and modifications can be effected within the spirit and scope of the invention.

What is claimed is:

1. Carrier particles for use in the development of electrostatic latent images which comprise magnetically hard ferrite material having a single phase hexagonal crystal structure and containing rare earth selected from the group consisting of neodymium, praseodymium, samarium, europium, mixtures thereof, and mixtures of at least one thereof with lanthanum.

2. The carrier particles of claim 1 wherein said magnetically hard ferrite material is selected from the group consisting of strontium ferrite, barium ferrite, lead ferrite, and mixtures thereof.

3. The carrier particles of claim 2 wherein said magnetically hard ferrite material is strontium ferrite.

4. The carrier particles of claim 2 wherein said magnetically hard ferrite material is barium ferrite.

5. The carrier particles of claim 2 wherein said magnetically hard ferrite material is lead ferrite.

6. The carrier particles of claim 1 having the formula $R_xM_{1-x}Fe_{12}O_{19}$ where R is rare earth selected from the group consisting of neodymium, praseodymium, samarium, europium, mixtures thereof, and mixtures of one or more thereof with lanthanum, x has a value such that said rare earth is present in an amount of about 1 to about 5% by weight, and M is selected from the group consisting of Ba, Sr, Ca, Pb, and mixtures thereof.

7. The carrier particles of claim 6 wherein x has a value such that said rare earth is present in an amount of about 2 to about 4.5% by weight.

8. The carrier particles of claim 1, where said particles are coated with a discontinuous tribocharging resin layer.

9. The carrier particles of claim 1 wherein said magnetically hard ferrite material exhibits a coercivity of at least 300 Oersteds when magnetically saturated, and an induced magnetic moment of at least 15 EMU/gm of carrier in an applied field of 1000 Oersteds.

10. The composition of claim 1 wherein said carrier particles comprise a composite of a binder and said magnetically hard ferrite material.

11. A method for developing an electrostatic image comprising contacting said image with a two-component dry developer composition comprising charged toner particles and oppositely charged carrier particles according to claim 1.

12. An electrostatic two-component dry developer composition for use in the development of electrostatic latent images which comprises a mixture of charged toner particles and oppositely charged carrier particles which comprise magnetically hard ferrite material having a single phase hexagonal crystal structure and containing rare earth selected from the group consisting of neodymium, praseodymium, samarium, europium, mixtures thereof, and mixtures of at least one thereof with lanthanum.

13. The composition of claim 12 wherein said magnetically hard ferrite material is selected from the group consisting of strontium ferrite, barium ferrite, lead ferrite, and mixtures thereof.

14. The composition of claim 13 wherein said magnetically hard ferrite material is strontium ferrite.

15. The composition of claim 13 wherein said magnetically hard ferrite material is barium ferrite.

16. The composition of claim 13 wherein said magnetically hard ferrite material is lead ferrite.

17. The composition of claim 12 wherein said carrier particles have the formula $R_xM_{1-x}Fe_{12}O_{19}$ where R is rare earth selected from the group consisting of neodymium, praseodymium, samarium, europium, mixtures thereof, and mixtures of at least one thereof with lanthanum, x has a value such that said rare earth is present in an amount of about 1 to about 5% by weight, and M is selected from the group consisting of Ba, Sr, Ca, Pb, and mixtures thereof.

18. The composition of claim 17 wherein said rare earth is present in an amount of about 2 to about 4.5% by weight.

19. The composition of claim 12 wherein said magnetically hard ferrite material exhibits a coercivity of at least 300 Oersteds when magnetically saturated, and an induced magnetic moment of at least 15 EMU/gm of carrier in an applied field of 1000 Oersteds.

* * * * *